United States Patent [19]

Borchert et al.

[11] 4,269,895

[45] May 26, 1981

[54] FREE-FLOWING PACKING MATERIAL OF FOAMED PLASTICS PARTICLES

[75] Inventors: Herbert Borchert; Walter Albert, both of Frankfurt am Main; Günter Kohaut, Königstein; Ulrich Schulte, Kelkheim; Bruno Rapp, Alsbach-Hähnlein, all of Fed. Rep. of Germany

[73] Assignee: Hoechst Aktiengesellschaft, Frankfurt am Main, Fed. Rep. of Germany

[21] Appl. No.: 91,779

[22] Filed: Nov. 6, 1979

[30] Foreign Application Priority Data

Nov. 8, 1978 [DE] Fed. Rep. of Germany ..... 2848338

[51] Int. Cl.[3] ..... B32B 27/00

[52] U.S. Cl. ..... 428/402; 206/523; 206/584; 428/33

[58] Field of Search ..... 206/523, 584; 428/33, 428/315, 402

[56] References Cited

U.S. PATENT DOCUMENTS

| | | | |
|---|---|---|---|
| 3,188,264 | 6/1965 | Holden | 428/33 |
| 3,481,455 | 12/1969 | Graham et al. | 206/523 |
| 4,104,440 | 8/1978 | Collins | 428/315 |

*Primary Examiner*—William J. Van Balen

*Attorney, Agent, or Firm*—Curtis, Morris & Safford

[57] ABSTRACT

The invention provides foamed plastics particles having a star-like shape the three legs of which are on the same plane. The ratio of particle thickness to particle height is from 1:2.75 to 1:3.3, that of leg width to particle height is from 1:2.2 to 1:2.5, and the particle height is from 10 to 60 mm. The particles of the invention are suitable as free-flowing packing material having a good flow and simultaneously a good interlocking capacity.

3 Claims, 1 Drawing Figure

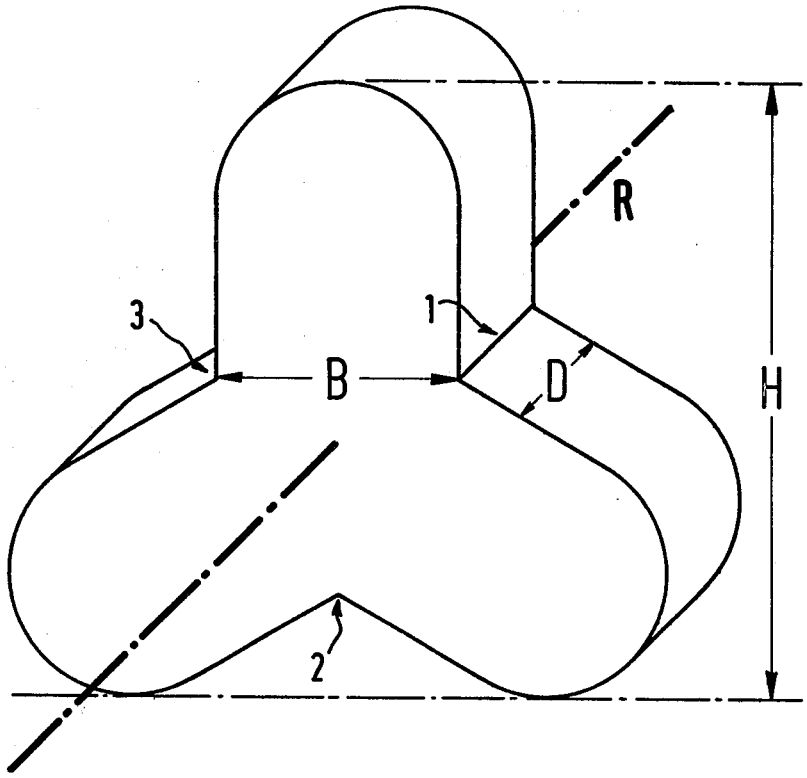
R
3
1
B
D
H
2

FREE-FLOWING PACKING MATERIAL OF FOAMED PLASTICS PARTICLES

The invention relates to a packing material consisting of loose foamed plastics particles, which due to their form and shape have very good flow properties and simultaneously a very good packing effect with respect to pressure and impact stress, and above all prevent any "migration" of the packaged articles.

Packing materials of loose foamed plastics particles are known, and used on a large scale because of their being free from dust, their resistance to moisture and mould formation, their stability to abrasion, and their inertness to the goods to be packaged, as well as their low weight. Usually, such packing material particles are provided in the form of compact, non-foamed granules containing an expanding agent, which are foamed according to known methods to their final shape in the packaging plant.

The effect of foamed plastics particles as packing material is based on the fact that, after the goods to be packaged are imbedded, they become interlocked within one another and thus form a certain "elastic shell" around the said goods. Thus mutual interlocking of the particles is especially important for preventing "migration" of the packaged article through the packing material particles due to transport shocks.

In contrast to the requirement of interlocking, the packing material particles must simultaneously have good flow properties. Usually, the light, foamed plastics particles are introduced into the corresponding packaging containers by falling freely from storage silos, which requires a perfect flow, because otherwise interlocking of the particles would cause "bridge formation" in the reservoir and thus disturb or prevent the uniform flow and therefore the quantitative dosage of the particles. Especially in the case of fully automatic packaging equipment, this may cause serious trouble.

Attempts have been made to reconcile these conflicting requirements to be met by adopting special shapes for the packing material particles in order to obtain a good flow on withdrawal from the reservoir simultaneously with good interlocking of the particles in the packaging container. In addition to these mechanical requirements to be met by the packing material, there is also the demand of the fire risk on storage and foaming of the particles to be reduced as far as possible.

Examples for the shape of such particles are the following:

S-shape, Y-shape, corrugated oblong or round lamellae, rings, slotted rings, 8-shaped hollow bodies, spiral bodies, particles having the shape of potatoe chips, hemispherical, saddle-shaped or dumbbell-shaped particles, or flakes.

Most of the particles so shaped have either good flow properties and poor interlocking capacity, or very good interlocking properties and poor flow.

It is therefore the object of the present invention to provide expandable plastic particles which after foaming yield a packing material having good flow properties and simultaneously a good interlocking capacity.

It has now been found that this object is surprisingly achieved by star-shaped particles of a defined dimensional ratio of height, thickness and width, which meet the requirements of flow properties and interlocking capacity in an especially satisfactory manner. The preferable use of flameproof expanding agents, for example trichlorofluoromethane, or substances splitting off an incombustible gas, for example carbon dioxide, as expanding agent for the particles of the invention meets the further requirement of the least fire risk.

The invention provides a free-flowing packing material consisting of foamed plastics particles having a star-like shape the three legs of which are on the same plane, wherein the ratio of particle thickness (D) to particle height (H) is from 1:2.75 to 1:3.3 and that of leg width (B) to particle height (H) is from 1:2.2 to 1:2.5; the height (H) being from 10 to 60 mm.

The invention will be better understood by reference to the accompanying FIGURE which shows a foamed packing particle. The surface completely visible on this drawing, corresponds to the position of the plane of section of the non-foamed particle, and it is in a vertical position with respect to the draw-off direction of the strand (R). The length of the particle in draw-off direction of the strand is defined as thickness (D).

When the particle having the shape as described is placed on a plane surface, the distance from the surface to the highest point of the particle indicates its height (H). Two of the three legs of the particle have a common line 1, 2, 3 (line of bending). The distance of these lines between each other is defined as width (B) of the legs.

When the ratio of particle thickness or leg width to particle height is outside of the ranges in accordance with the invention, only one of the required properties, flow or packing effect, is satisfactory, while the other one is poor, as demonstrated by the Comparative Examples. Thus, thin high particles, or particles having narrow long legs have a very good packing effect, but their flow is poor to such an extent that they cannot be fed without stoppage. On the other hand, particles the height and thickness of which are nearly identical, or the legs of which have such a width that the particles come near to triangular shape, have an excellent flow, but their packing effect is insufficient, so that the goods to be packaged migrate downward because of their weight.

The height of the foamed particles of the invention is from 10 to 60 mm, preferably 20 to 50 mm.

Suitable plastics material for the particles of the invention are the thermoplastics usually employed for foamed packing particles, preferably polystyrene.

In order to obtain the packing material, first compact non-foamed granules containing an expanding agent are manufactured by melting the plastic material in an extruder, feeding of a suitable expanding agent (preferably incombustible), for example trichlorofluoromethane or octafluorocyclobutane, to the plastics melt under pressure, extrusion of the expanding agent-containing melt through a corresponding forming outlet, and subsequent granulation. In order to prevent foaming on extrusion, the strands leaving the extruder are rapidly cooled, preferably in a water bath. Subsequently, the cooled strands are cut vertically to the draw-off direction into particles having a thickness which ensures that after foaming the particles have a shape according to the above ratio of D to H.

The expandable particles so obtained can be foamed by heating to a temperature above their softening point, for example by steam, to give the packing material of the invention. Usually, this foaming is carried out at the consumer's only. Instead of a physical expanding agent, a chemical expanding agent splitting off a gas on heating, such as steam, carbon dioxide or nitrogen, may be added to the plastic material before extrusion.

The use of an incombustible expanding agent has the advantage of the incombustible gas escaping on contact with a source of ignition to act as protective gas. Formation of an explosive gas/air mixture during storage, as this is the case when using for example pentane as expanding agent, is furthermore prevented, and even on possible burning of the foamed particles, a residual amount of expanding agent remaining in the cells can still act as protective gas to a certain extent.

The following Example illustrates the invention.

EXAMPLE

The superiority of the particles of the invention in their flow and packing behavior over particles having other dimensional ratios is shown in the following Table 1.

Four groups of star-shaped packing material particles of foamed polystyrene having different dimensions were manufactured and tested. The dimensions of 10 particles each of a group were measured, and the average of these measured dimensions was indicated.

In order to determine the flow properties, the following test was carried out: A container having vertical wall surfaces and a square bottom surface (edge length 0.5 mm) was charged with packing material particles the bulk volume of which was 80 liters. The bottom surface of the container was inclined towards the center at an angle of 45° and provided with a central square opening (edge length 0.15 m). The time required by the packing material for leaving this container in a free flow was the measure for the flow properties.

The packing behavior was examined on a vibrating table having the following data:

Frequency 50 Hertz: amplitudes: 40 and 50 mm horizontally, 50 mm vertically.

Horizontal acceleration: 15 g (147.15 m/sec$^2$) and 9.5 g (93.195 m/sec$^2$)

Vertical acceleration: 16 g (156.96 m/sec$^2$).

A container having vertical wall surfaces and a square bottom surface (edge length 0.5 m) was charged with packing material particles up to a height of 0.3 m. The material was then precompressed by a 1 second vibration. Subsequently, a steel cylinder specimen having a diameter of 32 mm, a length of 100 mm and a weight of 0.64 kg was placed in the center of the container in such a manner that its longitudinal axis was in horizontal position. The time which passed after switching-on of the vibrating table until the steel cylinder laid on the bottom of the container was determined. Five tests each of the flow and packing tests, respectively, were carried out, and the values so obtained are listed in Table 1. Packing material group 1 stands for the particles of the invention, while the packing material groups 2, 3 and 4 represent the particles having other dimensions.

The Table demonstrates that the particles of the invention are clearly superior to particles having other dimensions with respect to the combination of flow properties and packing capacity.

TABLE 1

Flow and packing behavior of star-shaped packing particles of foamed polystyrene

| packing material group | height (mm) | thickness (mm) | leg width (mm) | thickness: height | leg width: height | bulk density (g/l) | flow properties: flow time (s) | flow properties: stop-pages | packing behavior: sinking time (s) |
|---|---|---|---|---|---|---|---|---|---|
| 1 | 32 | 11 | 14 | 1:2.91 | 1:2.29 | 9.5 | 20 | — | 63 |
| | | | | | | | 22 | — | 51 |
| | | | | | | | 21 | — | 70 |
| | | | | | | | 21 | — | 68 |
| | | | | | | | 20 | — | 71 |
| 2[x] | 36 | 11 | 12 | 1:3.27 | 1:3.00 | 9.0 | 31 | 2 | 82 |
| | | | | | | | 33 | 2 | 95 |
| | | | | | | | 29 | 1 | 87 |
| | | | | | | | 34 | 2 | 88 |
| | | | | | | | 30 | 1 | 97 |
| 3[x] | 38 | 8 | 17 | 1:4.75 | 1:2.24 | 9.9 | 36 | 3 | 94 |
| | | | | | | | 38 | 3 | 105 |
| | | | | | | | 35 | 2 | 87 |
| | | | | | | | 40 | 4 | 104 |
| | | | | | | | 37 | 3 | 110 |
| 4[x] | 25 | 12.5 | 17 | 1:2.00 | 1:1.47 | 9.2 | 18 | — | 15 |
| | | | | | | | 20 | — | 23 |
| | | | | | | | 17 | — | 18 |
| | | | | | | | 17 | — | 20 |
| | | | | | | | 19 | — | 21 |

[x]comparative example

What is claimed is:

1. A free-flowing packing material consisting of foamed plastics particles having a three-legged, star-like shape the three legs of which are on the same plane, wherein the ratio of particle thickness (D) to particle height (H) is from 1:2.75 to 1:3.3 and that of leg width (B) to particle height (H) is from 1:2.2 to 1:2.5; the height (H) being from 10 to 60 mm.

2. A free-flowing packing material as claimed in claim 1, wherein the height (H) of the particles is in the range of from 20 to 50 mm.

3. A free-flowing packing material as claimed in claims 1 or 2, wherein the particles consist of polystyrene and are foamed by means of an incombustible expanding agent.

* * * * *